United States Patent [19]

Nixdorf

[11] Patent Number: 4,991,222

[45] Date of Patent: Feb. 5, 1991

[54] SOUND REPRODUCER

[76] Inventor: Hans W. Nixdorf, Pocking-Starnberg, Fed. Rep. of Germany

[21] Appl. No.: 501,341

[22] Filed: Mar. 28, 1990

Related U.S. Application Data

[63] Continuation of Ser. No. 127,128, Dec. 1, 1987, abandoned.

[30] Foreign Application Priority Data

Dec. 1, 1986 [DE] Fed. Rep. of Germany ..... 3641067

[51] Int. Cl.[5] ..... H04R 5/02; A47C 7/36

[52] U.S. Cl. ..... 381/188; 381/24; 381/187; 381/205; 297/391; 297/397

[58] Field of Search ..... 381/24, 86, 187, 188, 381/189, 205; 297/391, 397

[56] References Cited

U.S. PATENT DOCUMENTS

| | | | |
|---|---|---|---|
| 2,068,590 | 1/1937 | Applestam | 181/141 |
| 2,589,155 | 3/1952 | Smith | 297/391 |
| 2,742,654 | 4/1956 | Hurt | 441/123 |
| 2,908,766 | 10/1959 | Taylor | 297/391 |
| 3,290,450 | 12/1966 | Majoros | 381/24 |
| 3,384,719 | 5/1968 | Lanzara | 381/24 |
| 3,621,155 | 11/1971 | Pruitt | 381/205 |
| 3,771,181 | 11/1973 | Dansereau | 114/39.1 |
| 3,872,235 | 3/1975 | Manly, Jr. | 181/199 |
| 3,987,258 | 10/1976 | Tsutsui et al. | 381/159 |
| 4,038,499 | 7/1977 | Yeaple | 381/24 |
| 4,042,791 | 8/1977 | Wiseman | 381/24 |
| 4,070,553 | 1/1978 | Hass | 381/24 |
| 4,314,423 | 2/1982 | Lipsitz et al. | 446/303 |
| 4,440,443 | 4/1984 | Nordskog | 297/397 |
| 4,489,770 | 12/1984 | Reich, II | 381/159 |
| 4,668,201 | 5/1987 | Stark | 441/125 |
| 4,725,253 | 2/1988 | Politte | 441/130 |
| 4,771,722 | 9/1988 | Tihany | 441/131 |

FOREIGN PATENT DOCUMENTS

| | | | |
|---|---|---|---|
| 6602361 | 8/1966 | Netherlands | 297/391 |

*Primary Examiner*—Jin F. Ng
*Assistant Examiner*—M. Nelson McGeary
*Attorney, Agent, or Firm*—Kirkpatrick & Lockhart

[57] ABSTRACT

A sound reproducer which is to be associated with the head of a hearer thereof has at least one sound source and a holder therefor in the form of an inflatable cushion associated with the sound source to provide that it is disposed in a position of use which can be set by the person using the device. The inflatable cushion may be in the form of an inflatable head-support cushion which combines the sound source therein.

14 Claims, 1 Drawing Sheet

SOUND REPRODUCER

This is a continuation of copending application Ser. No. 0/127,128 filed on Dec. 1, 1987, now abandoned.

BACKGROUND OF THE INVENTION

This invention relates generally to a sound reproducer which in use is associated with the head of the person using same.

Such a sound reproducer generally comprises a sound source, for example a small-scale loudspeaker or mini-loudspeaker, or a headset loudspeaker, together with a suitable device for holding same.

However such headset arrangements are generally bulky and inconvenient and cumbersome when used on a head or support cushion. On the other hand however the effect of being totally shut away or screened off from the outside world, which occurs when using conventional headsets, is often undesirable. For that purpose there is rather a need for a cushion-like head support arrangement which frequently however takes up a really large amount of space when it has to be carried around with the user of the device.

SUMMARY OF THE INVENTION

An object of the present invention is to provide a sound reproducer to be operatively associated with the head of a hearer thereof, which is of a compact but efficient design.

Another object of the invention is to provide a sound reproducer with headset arrangement, which affords enhanced comfort and convenience for the user thereof.

Still another object of the invention is to provide a sound reproducer with a headset arrangement in which the loudspeaker members can be of a large size without being very noticeably obtrusive.

A still further object of the invention is to provide a sound reproducer which is conveniently incorporated into a support cushion member.

In accordance with the present invention, these and other objects are achieved by a sound reproducer which in use is associated with the head of a person using same, comprising at lease one sound source such as a small-scale loudspeaker or headset loudspeaker, and a holder therefor, and which further includes an inflatable means for arranging the at least one sound source in a position of use which can be set by the person using the sound reproducer.

In a preferred construction the invention provides the combination of the sound source or mini-loudspeaker with an inflatable cushion, in such a fashion that the at least one sound source is disposed in an opening in the wall of the inflatable cushion, preferably at the side of the inflatable interior thereof, with means for radiation of the sound to outside the cushion.

In that manner the sound reproducer according to the invention can be carried around by the person who wishes to use same in a tightly collapsed form, in the preferred embodiment including a head cushion or a cushion-type head support means. In that arrangement the mini-loudspeakers are additionally protected from damage, dust and from being affected by water, while in particular also the connecting cable thereof, which tends to be a sensitive part of such an arrangement, is protected from being torn away. Where the sound source such as a loudspeaker is connected to an audio tape device, the audio tape device may be disposed in a dust-proof and water-tight manner in a separate pocket which can be sealingly closed in the support cushion.

An important advantage of the sound reproducer in accordance with the invention involving the arrangement of at least one headset loudspeaker within an inflatable cushion, is that the loudspeakers do not necessarily have to be of a very small size, but while being flat and also light in weight, can be larger in terms of diameter than the usual kind of loudspeaker member used in headset arrangements, and thus can be designed to give an improved quality of sound. That therefore makes it possible to use headset arrangements with pocket audio tape devices in a much broader leisure area than hitherto, for example on the beach, in particular on a sandy beach, when using reclining mats, beside and on the water, or when using swimming support cushions or air mattresses. The invention also provides the option of use, in a compact construction, as head support cushions with audio entertainment, for example as head support rests in connection with the seats for passengers in motor vehicles.

In a preferred feature of the invention, by virtue of a particular configuration of the inflatable cushion, it is also possible to vary the position of association with the head of the user of the sound sources, preferably with stereo sound reproduction, simply by virtue of inflating the cushion to a different degree or by virtue of the configuration of the cushion itself. For example the invention may provide that the cushion has a head-supporting central portion and at least one side portion which is connected to the central portion pivotably towards and away from the head of the person using the arrangement, with the at least one sound source being integrated in the side portion. The side portion or the two side portions provide for the desired position of use of the at least one sound source relative to the head or the ears of the person using the arrangement, with a modified condition of inflation of the cushion or the central portion thereof.

In that connection, the cushion central portion and the side portions may be independent of each other and may thus be inflatable independently of each other. The position of the one or more loudspeakers relative to the ears of the person using the arrangement is adjusted in accordance with the invention on the one hand by putting the various parts of the cushion into different positions, and also be inflating the cushion parts to different levels of inflation pressure.

In accordance with the concept of the present invention, the arrangement of the invention may also be used in relation to lifejackets, in which case instructions can be transmitted to the wearer of the lifejacket by way of one or more loudspeakers which are for example disposed laterally in the neck-supporting portion of the lifejacket.

Use of the arrangement according to the invention in animal figures is attractive in particular to children. In that case, the one or more loudspeakers may be disposed for example in the ears of a Mickey Mouse figures, the ears extending from a neck support portion in the form of a face, and extending on both sides of the head of the child using the sound reproducer arrangement.

By virtue of adopting a specific configuration of the inflatable loudspeaker-carrying cushion in accordance with the invention, it is also possible for the wall and the internal chamber thereof to constitute resonance bodies; in that case, audio reception for the person whose head is lying on the cushion and supported thereby can be increased by virtue of space resonance and also by the transmission of sound through the solid material involved in the construction of the arrangement according to the invention.

The cushion surfaces may also be used as advertising surfaces.

For other situation of use, for example for joggers, walkers, pedalcyclists and the like, the use of inflatable headset holding elements may also be advantageous in that the headset arrangement can be folded down to a very small size but can nonetheless be fixedly fitted to the head of the user.

For example, in accordance with the invention, the holding means for the headset loudspeaker or loudspeakers may be a flexible headband on which the sound source or sources or headset loudspeaker or loudspeakers is or are disposed parallel to the sides of the head of the user of the arrangement, on a lever which is secured by its central portion to the headband while at its end which projects downwardly therefrom, it has the headset loudspeaker or loudspeakers which is or are towards the ear or ears of the person using the arrangement. At its upwardly projecting end, towards the side of the head, the above-mentioned lever carries an inflatable cushion means which in the inflated condition bears against the head of the user and holds the headset loudspeaker or loudspeaker against the respective ear of the user.

Further objects, features and advantages of the present invention will be apparent from the following description of preferred embodiment thereof.

DESCRIPTION OF PREFERRED EMBODIMENTS

Figure 1:
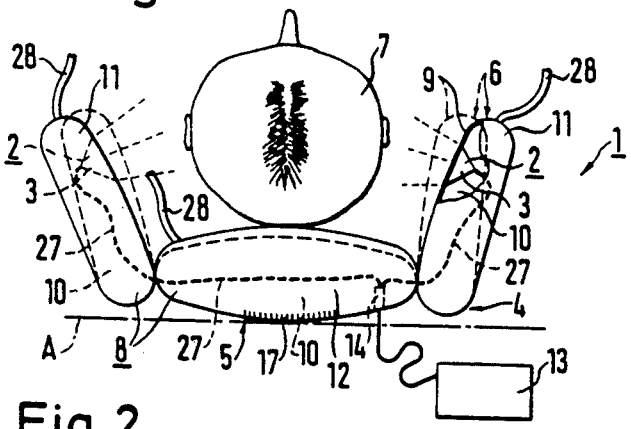
FIG. 1 is a side view of an arrangement according to the invention, from a point of view of above the head of the person using the arrangement.
Figure 2:
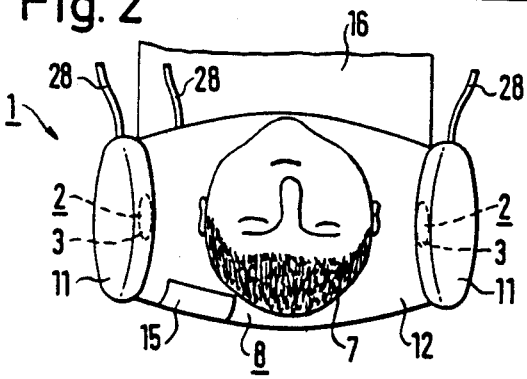
FIG. 2 is a plan view of the construction shown in FIG. 1, that is to say, on to the face of a recumbent person using the arrangement according to the invention.

Referring firstly to FIGS. 1 and 2, shown therein is a sound reproducer 1 which comprises an inflatable cushion arrangment 8 having a head-supporting central portion 12 and first and second side portions 11 which are disposed at respective sides of the central portion 12 and which are shown in FIG. 1 in two different angular positions (in solid lines and in broken lines respectively) relative to the head or more specifically the ears of a person using the sound reproducer arrangement, as indicated at 7. In a corresponding manner the head-supporting central portion 12 is also shown in broken lines in a position of use in which it is inflated to a lesser extent. Reference numeral 6 denotes the broken-line position of the side portions 11.

Disposed in the wall 9 of the cushion 8 and more specifically the side portions 11 thereof are sound sources as indicated at 2, for example in the form of small-scale or headset loudspeakers which are more specifically indentified at 3, namely at both sides of the head of the person 7, so that the cushion 8 with it side portions 11 forms a holding means as indicated by reference numeral 4 in FIG. 1, for two small-scale or headset loudspeakers 3, including preferably for stereo sound reproduction.

The loudspeakers 3 are air-tightly integrated into the surface of the respective side portions 11 in such a way that they extend into the hollow interior 10 thereof and produce their sound in an outward direction from the cushion or side portions 11, that is to say, towards the head or the ears of the person 7. Reference numeral 27 in FIG. 1 denotes connecting cables which run within the cushion 8, including in parts of the wall 9 thereof, for example in the edges thereof, and go to a connecting socket indicated at 14 for connecting an audio tape device 13 thereto. The device can be disposed as shown in FIG. 2 in a water-tightly closable pocket 15 within the interior 10 of the cushion 8. FIG. 2 also indicates the connection of the inflatable cushion arrangement 8 to a body support member such as an air mattress as indicated at 16, so that the cushion arrangement is additionally fixed in its position of use.

For use of the inflatable cushion 8 for example on the backrest of a seat or chair or on the headrest of a motor vehicle passenger seat, the cushion 8 may be provided at its rear side with a fixing means as indicated by way of example at 17 at FIG. 1, which extends over a substantial part of the surface of the cushion 8. The fixing means 7 may be for example of the type comprising interengaging hooks and eyes, known also as a 'velcro' fixing means. In order to vary the position of use of the cushion arrangement as indicated at 6 in FIG. 1, the cushion 8 in its central portion 12 and its side portions 11 can be selectively inflated to varying degrees, by way of separate inflation hoses as indicated at 28, with non-return valves. For that purpose, the configuration or profile of the central portion 12 and the side portions 11 as well as the manner in which they are pivotally connected together may also be such as to provide a level support effect on a support surface as indicated at A in FIG. 1, on which the cushion arrangement is disposed.

It will be seen therefore that the cushion support arrangement as indicated generally by reference numeral 5 in FIG. 1 can be adapted to the requirements of the person using the arrangement.

Figure 3:
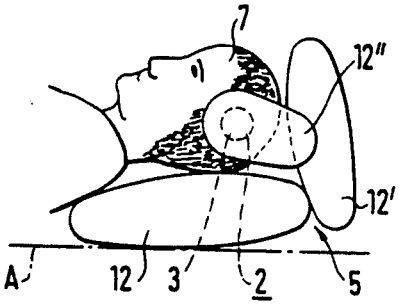
FIG. 3 is a side view of a modified embodiment of the arrangement according to the invention.
Figure 4:
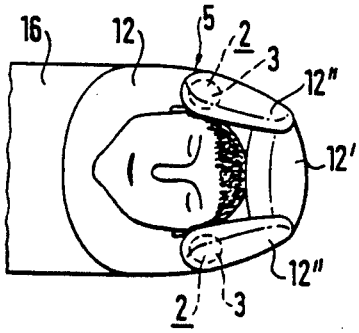
FIG. 4 is a view similar to that shown in FIG. 2 of the FIG. 3 embodiment.

Referring now to FIGS. 3 and 4, shown therein is another embodiment of the inflatable cushion arrangement 5 having a head-supporting cushion as indicated at 12 and a further cushion member as indicated at 12' which is disposed adjacent the top of the head of the person 7 using the arrangment. Reference numeral 12'' indicates laterally disposed ear portions which may be for example in the form of the ears of an animal figure. The small-scale or headset loudspeakers 3 may be disposed in or on the lateral ear portions 12''.

Figure 5A:
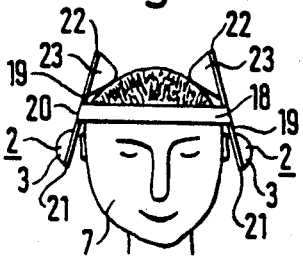
FIG. 5*a* is a front view of a further modified embodiment of the arrangement according to the invention.
Figure 6:
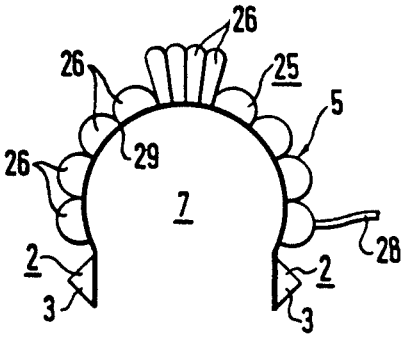
FIG. 6 is a view from the front of a still further modified embodiment of the arrangement according to the invention.
Figure 5B:
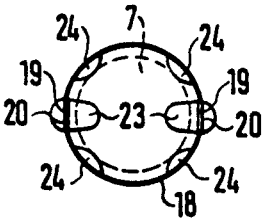
FIG. 5*b* is a plan view from above of the FIG. 5*a* embodiment.

The inflatable arrangement 5, acting as a holding means 4 for the loudspeakers 3, may also be secured to the head of the person 7 by way of inflatable means, as shown in FIGS. 5*a*, 5*b* and 6.

For the purpose, as shown in FIGS. 5*a* and 5*b*, the arrangement may be provided with a flexible headband 18 on which levers 19 are mounted by way of their central portion as indicated at 20, on both sides of the head of the person 7. The downwardly projecting end portion 21 of each lever 19 carries a respective sound source as indicated at 3 in FIG. 5*a*, in such a way as to be directed towards the ears of the person 7. As an alternative to extending downwardly from the headband 18, the end portion 21 which carries the respective sound source or loudspeaker 3 may project from a rearward position forwardly, when the levers 19 are mounted in the region of the rearward part of the head of the person 7.

Provided at the other end portion 22 of each lever 19, being the end portion which generally projects upwardly, there is an inflatable cushion device 23 which, in the inflated condition, bears agains the head of the person 7 and thereby holds the respective loudspeakers 3 in a position of use against or in the close proximity of the ears of the person 7.

The headband 18 may be itself inflatable or it may incorporate spacer cushion portions 24, as shown in FIG. 5*b*, so that it is held firmly but not tightly against the head of the person using the arrangement.

Finally, as shown in FIG. 6, the inflatable arrangement 5 may also be in the form of a headset band 25 which extends over the head of the user but which, as in the above-described embodiments of the arrangement according to the invention, comprises inflatable members so that when the inflatable members are deflated, the arrangement can be completely folded down into a compact configuration when not required for use. That therefore also provides an arrangement which is of light weight and which is not oppressive in use.

In accordance with the invention, as shown in FIG. 6 the loop configuration of the headband is produced by virtue of the fact that air chambers 26 are inflated by way of inflation hoses 28, the chambers 26 being arranged at the outward side of a flexible or bendable band 29 and, when suitably inflated, forming a re-collapsible headset band 25, by virtue of the side wall portions of the chambers 26 being urged apart by the inflation pressure.

It will be appreciated that the foregoing embodiments have been set forth solely by way of example of the principles of the present invention and that various modifications and alterations may be made therein without thereby departing from the spirit and scope thereof.

What is claimed is:

1. A sound reproducer arrangement adapted to be associated with the head of a person using same, comprising an inflatable cushion having a head-supporting central portion and at least one side portion, said central portion and said side portion being inflatable independently of each other; a sound source integrated in said side portion; and means for pivotally connecting said side portion to said central portion such that a plurality of obtuse angles can be formed between said side and central portions by varying the degree of inflation of said side portion.

2. An arrangement as set forth in claim 1 wherein said sound source is a loudspeaker.

3. An arrangement as set forth in claim 1 wherein said side portion of said cushion has a flexible wall and said sound source is disposed in said wall of said cushion, with radiation of the sound produced to outside said cushion.

4. An arrangement as set forth in claim 3 wherein said sound source transmits sound vibrations to said wall of said side portion of said cushion.

5. An arrangement as set forth in claim 3 and including a connecting cable disposed in said wall of said cushion.

6. An arrangement as set forth in claim 5 wherein said cable is fixed in an edge portion of said wall of said cushion.

7. An arrangement as set forth in claim 1 wherein said sound source is water-resistant.

8. An arrangement as set forth in claim 1 wherein said sound source is adapted to be connected to an audio tape device a connecting socket for connected thereof being provided on said cushion.

9. An arrangement as set forth in claim 1 wherein said cushion is provided with a water-tight closable pocket for accommodating an audio tape device.

10. An arrrangement as set forth in claim 1 wherein said cushion is connected to a body support portion.

11. An arrangement as set forth in claim 10 wherein said body support portion is an air mattress.

12. An arrangement as set forth in claim 1 wherein at its rear said cushion has a fixing means for releasably fitting it to a neck-supporting portion of a seat.

13. An arrangement as set forth in claim 1 wherein on its front said cushion has an attachment means for a hygiene support surface.

14. An arrangement as set forth in claim 1 including an inflatable headset bow having at least one inflatable chamber for alighting said sound source and holding same against an ear of the person using the arrangement.

* * * * *

UNITED STATES PATENT AND TRADEMARK OFFICE

CERTIFICATE OF CORRECTION

PATENT NO. : 4,991,222

DATED : February 5, 1991

INVENTOR(S) : Hans W. Nixdorf

It is certified that error appears in the above-identified patent and that said Letters Patent is hereby corrected as shown below:

Col. 1, line 44, delete "lease" and substitute therefor --least--.

Col. 3, line 28, delete "loudspeaker" and substitute therefor --loudspeakers--.

Col. 4, line 35, delete "at" (2nd occur.) and substitute --in--.

Col. 4, line 48, delete "level" and substitute therefor --lever--.

Col. 4, line 60, delete "arrangment" and substitute therefor --arrangement--.

Col. 5, line 1, delete "the" , first instance, and substitute therefor --that--.

Col. 5, line 10, delete "agains" and substitute therefor --against--.

Col. 6, line 32, after "device" insert a --,--.

Col. 6, line 32, delete "connected " and substitute therefor --the connection--.

Col. 6, line 49, delete "alighting" and substitute therefor --aligning--.

UNITED STATES PATENT AND TRADEMARK OFFICE

CERTIFICATE OF CORRECTION

PATENT NO. : 4,991,222

DATED : February 5, 1991

INVENTOR(S) : Hans S. Nixdorf

It is certified that error appears in the above-identified patent and that said Letters Patent is hereby corrected as shown below:

Col. 6, line 49, delete "alighting" and substitute therefor --aligning--.

Signed and Sealed this

Twenty-ninth Day of September, 1992

*Attest:*

DOUGLAS B. COMER

*Attesting Officer*

*Acting Commissioner of Patents and Trademarks*